US010729258B2

(12) United States Patent
Godbole

(10) Patent No.: US 10,729,258 B2
(45) Date of Patent: Aug. 4, 2020

(54) BEVERAGE DISPENSER HAVING AT LEAST ONE TILTED AND GRAVITY ASSISTED ROTATING TRAY

(71) Applicant: The Coca-Cola Company, Atlanta, GA (US)

(72) Inventor: Vinayak Godbole, Peachtree city, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 0 days.

(21) Appl. No.: 15/778,060

(22) PCT Filed: Oct. 31, 2016

(86) PCT No.: PCT/US2016/059671

§ 371 (c)(1),
(2) Date: May 22, 2018

(87) PCT Pub. No.: WO2017/091324

PCT Pub. Date: Jun. 1, 2017

(65) Prior Publication Data

US 2018/0344052 A1 Dec. 6, 2018

Related U.S. Application Data

(60) Provisional application No. 62/259,905, filed on Nov. 25, 2015.

(51) Int. Cl.
*A47F 3/04* (2006.01)
*F25D 25/02* (2006.01)
(Continued)

(52) U.S. Cl.
CPC ..... *A47F 1/12* (2013.01); *A47F 3/0404* (2013.01); *A47F 3/0408* (2013.01);
(Continued)

(58) Field of Classification Search
CPC ..... A47F 3/048; A47F 3/0486; A47F 3/06; A47F 3/0408; A47F 3/0404; A47F 3/10;
(Continued)

(56) References Cited

U.S. PATENT DOCUMENTS 2,066,865 A 1/1937 Warner
4,977,754 A 12/1990 Upton et al.
(Continued)

OTHER PUBLICATIONS

Extended EP Search Report, PCT/US2016/059671, dated May 20, 2019 (6 pp.).

(Continued)

*Primary Examiner* — Kimberley S Wright
(74) *Attorney, Agent, or Firm* — Eversheds Sutherland (US) LLP

(57) ABSTRACT

A beverage dispenser for dispensing one or more products is disclosed. The beverage dispenser may include a housing having a dispensing port, a shaft disposed within the housing, and a tray rotatably attached to the shaft. The tray may be tilted towards the dispensing port relative to the shaft. The tray may rotate the one or more products disposed thereon to the dispensing port via gravity after one of the one or more products disposed on the tray is dispensed.

12 Claims, 7 Drawing Sheets

(51) Int. Cl.

| | |
|---|---|
| ***A47F 1/12*** | (2006.01) |
| ***A47F 7/28*** | (2006.01) |
| ***A47F 3/10*** | (2006.01) |
| ***G07F 11/54*** | (2006.01) |
| ***A47F 3/06*** | (2006.01) |
| ***A47F 3/14*** | (2006.01) |
| ***A47F 7/00*** | (2006.01) |

(52) U.S. Cl.
CPC ..... *A47F 3/0486* (2013.01); *A47F 3/06* (2013.01); *A47F 3/10* (2013.01); *A47F 3/14* (2013.01); *A47F 7/0071* (2013.01); *A47F 7/28* (2013.01); *G07F 11/54* (2013.01)

(58) Field of Classification Search
CPC .. A47F 3/14; A47F 1/12; A47F 7/0071; A47F 7/28; G07F 11/54
See application file for complete search history.

(56) References Cited

U.S. PATENT DOCUMENTS

| | | | | |
|---|---|---|---|---|
| 5,097,673 | A * | 3/1992 | Negishi | A47F 3/0452 312/118 |
| 5,277,486 | A | 1/1994 | Bustos | |
| 5,595,310 | A | 1/1997 | Spamer et al. | |
| 5,884,567 | A * | 3/1999 | Bartz, Jr. | A47B 57/04 108/106 |
| 6,238,032 | B1 * | 5/2001 | Cooper | A47B 57/10 211/187 |
| 6,309,034 | B1 * | 10/2001 | Credle, Jr. | A47F 3/043 108/94 |
| 8,459,474 | B2 | 6/2013 | Sagel | |
| 2010/0012676 | A1 | 1/2010 | Freedman | |
| 2010/0230368 | A1 | 9/2010 | Slade | |

OTHER PUBLICATIONS

International Search Report and Written Opinion, PCT/US2016/059671, dated Feb. 2, 2017 (11 pp.).

* cited by examiner

BEVERAGE DISPENSER HAVING AT LEAST ONE TILTED AND GRAVITY ASSISTED ROTATING TRAY

CROSS-REFERENCE TO RELATED APPLICATIONS

The disclosure claims priority to and the benefit of U.S. provisional application No. 62/259,905, filed Nov. 25, 2015, which is incorporated by reference herein in its entirety.

FIELD OF THE DISCLOSURE

The disclosure generally relates to beverage dispensers and more particularly relates to beverage dispensers having at least one tilted and gravity assisted rotating tray.

BACKGROUND

Typical cold beverage merchandizers are designed to enable easy product access to the consumer. For example, most merchandisers include solid or transparent doors, which the consumer opens in order to access a product from a product shelf. In some instances, when a product is removed from the product shelf, the spot remains empty. In such instances, the next consumer must reach deeper into the product shelf in order to get the next available product, which may prove difficult for the consumer. Open front coolers may provide easier access to products, but require larger and more expensive refrigeration systems to maintain the products at desired temperatures.

SUMMARY

Some or all of the above needs and/or problems may be addressed by certain embodiments of the disclosure. For example, according to an embodiment, a beverage dispenser for dispensing one or more products is disclosed. The beverage dispenser may include a housing having a dispensing port, a shaft disposed within the housing, and a tray rotatably attached to the shaft. The tray may be tilted towards the dispensing port relative to the shaft. The tray may rotate the one or more products disposed thereon to the dispensing port via gravity after one of the one or more products disposed on the tray is dispensed or otherwise removed from the tray.

Other features and aspects of the beverage dispenser will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
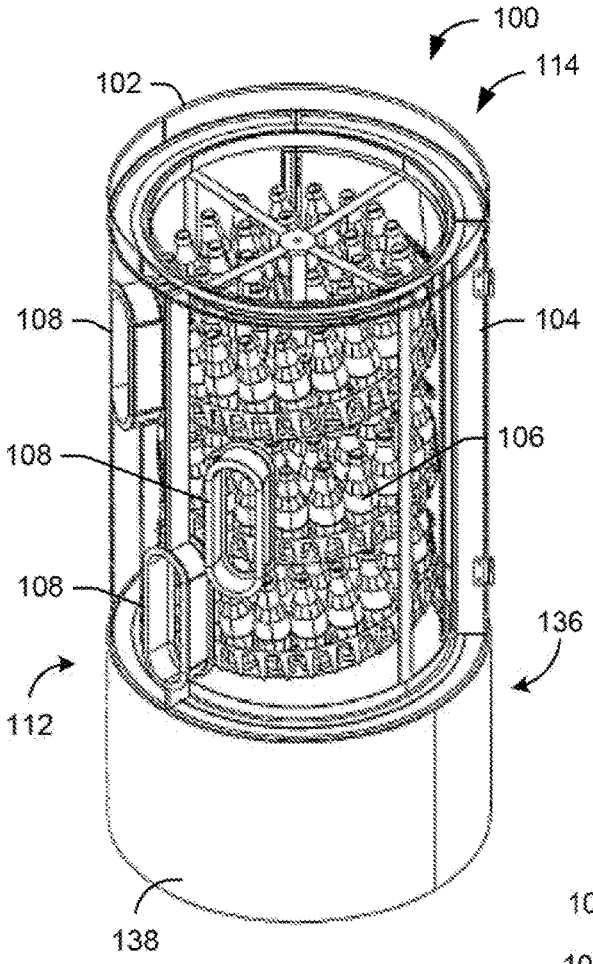
FIG. 1 depicts an upper perspective view of a beverage dispenser in accordance with one or more embodiments of the disclosure.

Described below are embodiments of a beverage dispenser (as well as individual components of the beverage dispenser). Methods of manufacturing and using the beverage dispenser are also disclosed. The beverage dispenser may include at least one tilted and gravity assisted rotating tray. For example, the rotating tray may be tilted in the direction of a dispensing port or access port. When a product is dispensed (i.e., removed from the tray via the dispensing port or access port), the center of gravity of the remaining product(s) on the tray may shift, causing an imbalance, and the tray may rotate using gravity to bring another product to the dispensing port. In this manner, the beverage dispenser does not require any power or drive mechanism because the tilt and rotation of the tray enables self-alignment of another product on the tray to the dispensing port or access port using gravity. As a result, the tray may automatically rotate another product to the dispensing port after a product is dispensed.

Generally speaking, the beverage dispenser, which may also be referred to as a cold beverage merchandiser or cooler, may be configured to dispense or otherwise enable access to one or more products. The beverage dispenser may include a housing having a dispensing port or access port, a shaft disposed within the housing, and a tray rotatably attached to the shaft. The tray may be tilted towards the dispensing port or access port relative to the shaft. In this manner, the tray may rotate a product disposed on the tray to the dispensing port via gravity after another product disposed on the tray is dispensed or otherwise removed from the tray.

In some instances, the beverage dispenser may include number of trays and a number of dispensing ports or access ports. For example, the trays may be vertically stacked along the shaft. Each of the trays may be associated with a respective dispensing port or access port. In some instances, the dispensing ports or access ports may be offset from one another. That is, the dispensing ports or access ports may be staggered about the housing. In such instances, the trays may tilt in different directions. In other instances, the dispensing ports or access ports may be aligned. In such instances, the trays may tilt in the same direction. In yet other instances, some of the dispensing ports or access ports may be offset and some may be aligned. In such instances, some of the trays may tilt in different directions and some of the trays may tilt in the same direction. Any number of dispensing ports or access ports and trays may be used.

In certain embodiments, the housing may be transparent and include an access door for stocking the products therein. In addition, a frame may be disposed within the housing. The shaft may be attached to the frame. For example, the frame may support the shaft in a vertical orientation. In some instances, a refrigeration unit may be in thermal communication with the housing. For example, the refrigeration unit may form a base upon which the housing is disposed.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

Figure 2:
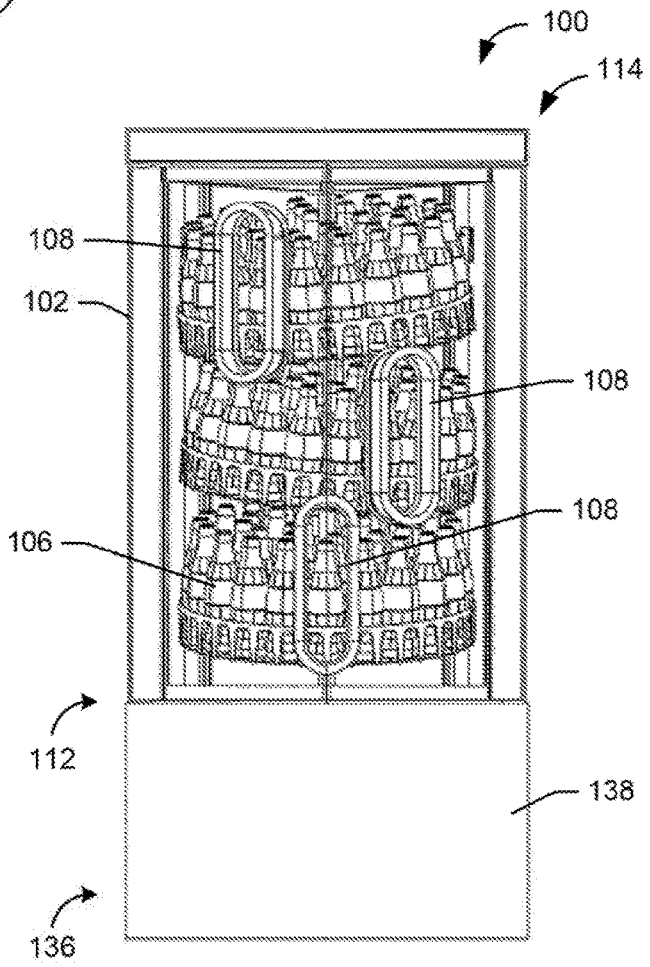
FIG. 2 depicts a front view of a beverage dispenser in accordance with one or more embodiments of the disclosure.
Figure 3:
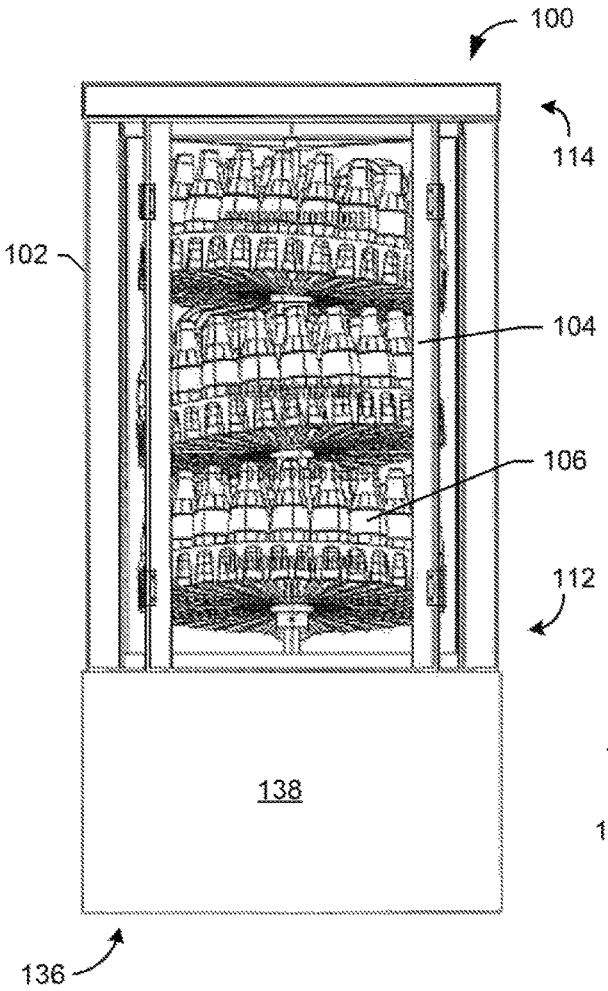
FIG. 3 depicts a back view of a beverage dispenser in accordance with one or more embodiments of the disclosure.
Figure 4:
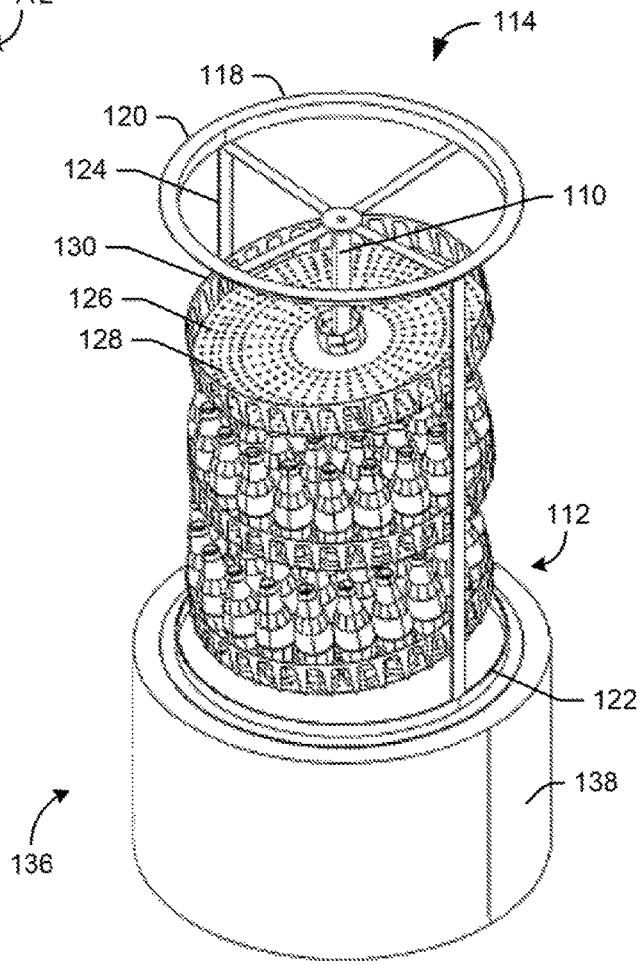
FIG. 4 depicts an upper perspective view of a beverage dispenser with the housing and some of the products removed for illustrative purposes in accordance with one or more embodiments of the disclosure.
Figure 5:
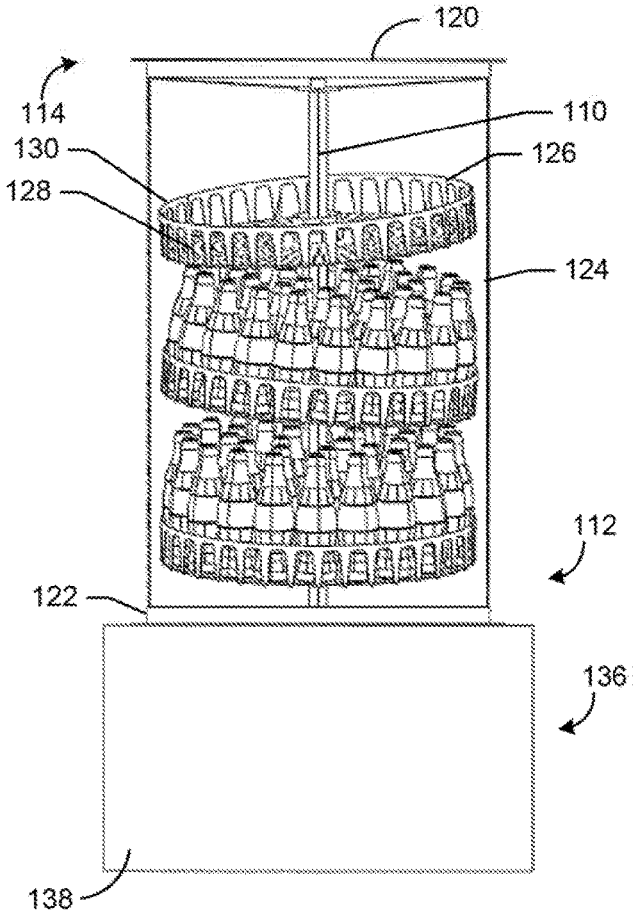
FIG. 5 depicts front view of a beverage dispenser with the housing and some of the products removed for illustrative purposes in accordance with one or more embodiments of the disclosure.
Figure 6:
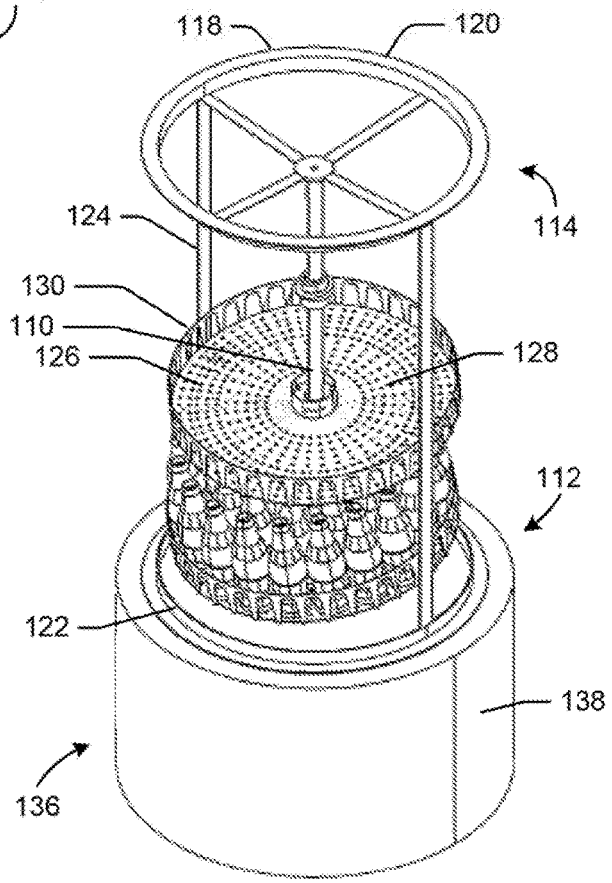
FIG. 6 depicts an upper perspective view of a beverage dispenser with the housing, the top tray, and some of the products removed for illustrative purposes in accordance with one or more embodiments of the disclosure.
Figure 7:
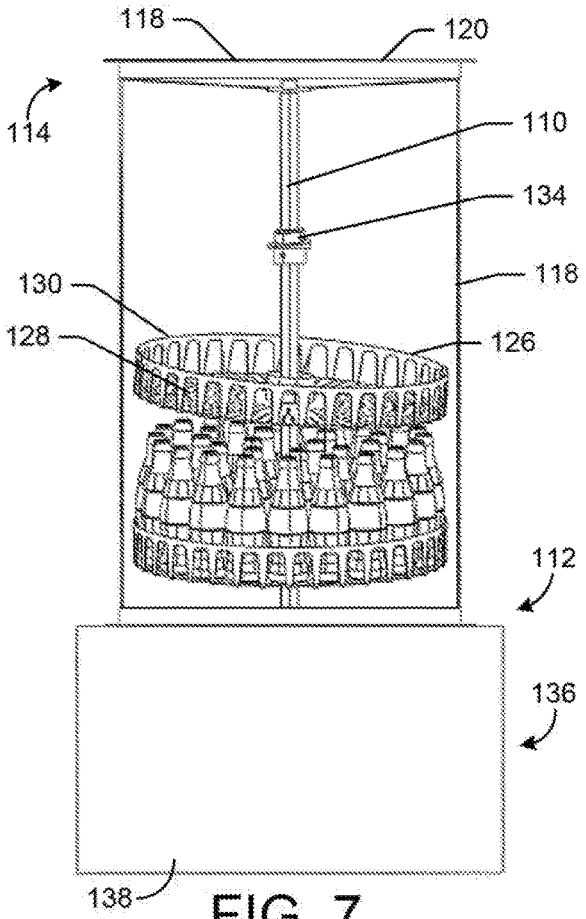
FIG. 7 depicts a front view of a beverage dispenser with the housing, the top tray, and some of the products removed for illustrative purposes in accordance with one or more embodiments of the disclosure.
Figure 8:
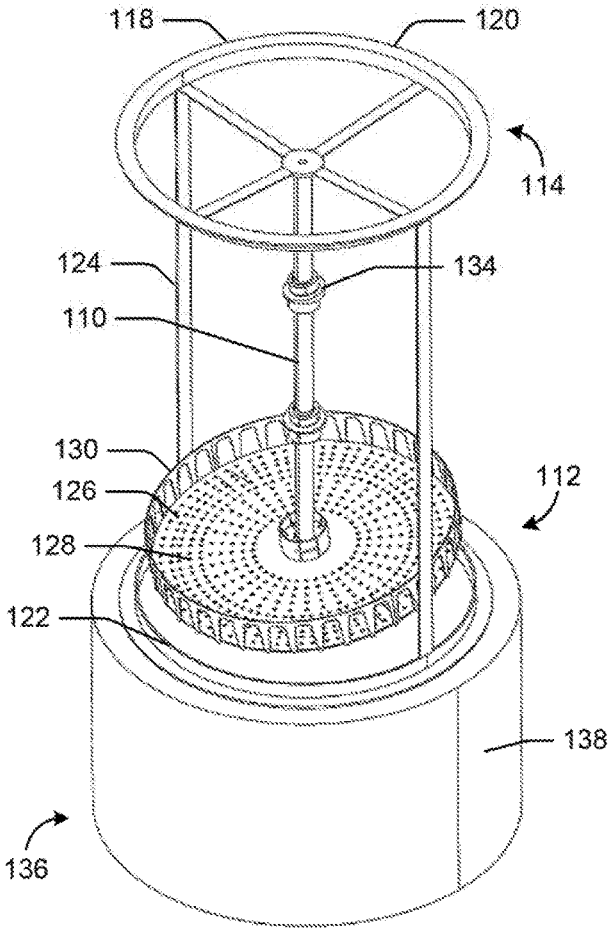
FIG. 8 depicts an upper perspective view of a beverage dispenser with the housing, the top tray, the middle tray, and some of the products removed for illustrative purposes in accordance with one or more embodiments of the disclosure.

FIGS. 1-3 depict a beverage dispenser 100. In the various embodiments described herein, the beverage dispenser 100 may also be referred to as a temperature controlled product merchandiser, a cold beverage merchandiser, or a cooler. The beverage dispenser 100 may include a housing 102. In some instances, the housing 102 may be a circular enclosure. The housing 102 also may be at least partially transparent or include one or more transparent panels. The size, shape, and configuration of the housing 102 may vary. The housing 102 may include an access door 104 for stocking one or more products 106 within the housing 102. In some instances, the access door 104 may be a hinged door disposed on a back portion of the housing 102. In this manner, the housing 102 may be configured to house one or more products 106 therein. The size, shape, and configuration of the access door may vary.

In some instances, the one or more products 106 may include beverage containers, such as bottles, cans, pouches, or the like. Other products or items, such as perishable and/or non-perishable foods or drinks, may be stored within the housing 102. Any item may be stored within the housing 102. The housing 102 may be thermally insulated. The housing 102 may be cooled or heated. As discussed below, the products 106 may be dispensed or otherwise accessed and removed from the housing 102.

The housing 102 may include a dispensing port 108 or a number of dispensing ports 108. In the various embodiments described herein, the dispensing port 108 may also be referred to as an access port. The dispensing port 108 may comprise a hole or aperture through the housing 102 suitable for removing the products 106. The size, shape, and configuration of the dispensing port 108 may vary. The products 106 may be dispensed from the housing 102 by way of the dispensing port 108. That is, a consumer may access the products 106 by way of the dispensing port 108. For example, a consumer may remove a product 106 from the housing 102 by pulling it out of the dispensing port 108. In some instances, the dispensing port 108 may include a door or the like to increase the thermal efficiency of the housing 102. As discussed below, any number of dispensing ports 108 may be used.

Figure 9:
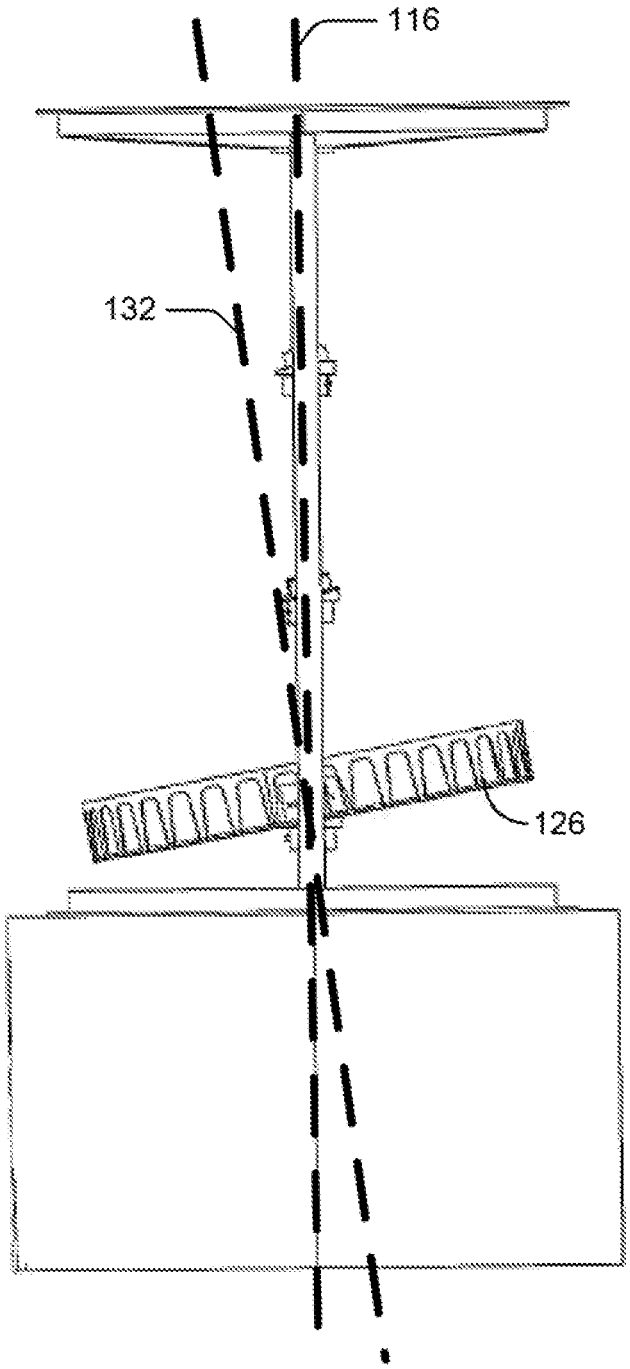
FIG. 9 depicts a side view of a beverage dispenser with the housing, the top tray, the middle tray, and some of the products removed for illustrative purposes in accordance with one or more embodiments of the disclosure.

As depicted in FIGS. 4-8, in certain embodiments, a shaft 110 may be disposed within the housing 102. The shaft 110 may be an elongated rod or the like. The size, shape, and configuration of the shaft 110 may vary. In one example embodiment, the shaft 110 may be centrally located within the housing 102 and extend vertically from a bottom portion 112 of the housing 102 to a top portion 114 of the housing 102 along an axis 116 (as depicted in FIG. 9) of the shaft 110. In some instances, the shaft 110 may be supported within the housing by a frame 118. The frame 118 may include a top portion 120, a bottom portion 122, and one or more side supports 124. The size, shape, and configuration of the frame 118 may vary. In some instances, the frame 118 may be omitted, and the shaft 110 may be attached directly to the housing 102.

A tray 126 may be rotatably attached to the shaft 110. In some instances, the tray 126 may include a circular base 128 with a lip 130. The circular base 128 may have one or more holes or slots therein to promote air flow through the circular base 128. Moreover, the lip 130 may include one or more holes or archways to further promote air flow through and around the tray 126. The size, shape, and configuration of the tray 126 may vary. The products 106 may be stored on the tray 126 within the housing 102.

The tray 126 may be tilted towards the dispensing port 108 relative to the shaft 110. That is, an axis of rotation 132 (as depicted in FIG. 9) of the tray 126 may be offset from the axis 116 of the shaft 110 in a direction of the dispensing port 108. In other words, the axis of rotation 132 of the tray 126 is offset by an angle from the vertical. In some embodiments, the offset angle is great enough to enable a product to slide along the circular base 128 of the tray 126 until it comes into contact with the lip 130. In some instances, the tray 126 may be attached to the shaft 110 by way of a tilt bearing 134 (or other type of pivoting mechanism), which may enable the tray 126 to rotate on a titled plane. In this manner, the tray 126 may rotate the products 106 disposed on the tray 126 to the dispensing port 108 via gravity after one of the products 106 disposed on the tray 126 is dispensed. For example, when a product 106 is dispensed (i.e., removed from the tray 126 via the dispensing port 108), the center of gravity of the remaining product(s) 106 on the tray 126 may shift, causing an imbalance, and the tray 126 may rotate using gravity to bring another product 106 to the dispensing port 108. In this manner, the tray 126 may be gravity assisted, causing it to rotate due to an imbalance of the center of gravity. The tray 126 may automatically rotate a product 106 to the dispensing port 108 after a product 106 is dispensed without any power or drive mechanism because the tilt and rotation of the tray 126 enables self-alignment of the tray 126 with the dispensing port 108 using gravity.

In some instances, the beverage dispenser 100 may include a number of trays 126 and a number of dispensing ports 108. For example, the trays 126 may be vertically stacked within the housing along the shaft 110. Any number of trays 126 and any number of dispensing ports 108 may be used.

In certain embodiment, each of the trays 126 may be associated with a respective dispensing port 108. In some instances, the dispensing ports 108 may be offset from one another. That is, the dispensing ports 108 may be staggered about the housing 102. In such instances, as depicted in FIG. 2, the trays 126 may tilt in different directions towards their respective dispensing ports 108. In other instances, the dispensing ports 108 may be aligned. In such instances, the trays 126 may tilt in the same direction. In yet other instances, some of the dispensing ports 108 may be offset and some may be aligned. In such instances, some of the trays 126 may tilt in different directions and some of the trays 126 may be tilted in the same direction. In still other instances, a number of trays 126 may be associated with a single dispensing port 108. Any number of dispensing ports 108 and trays 126 may be used.

In some instances, a refrigeration unit 136 may be in thermal communication with the housing 102. For example, the refrigeration unit 136 may be disposed within a casing 138 that may form a base upon which the housing 102 is disposed. Cold air generated by the refrigeration unit 136 may be circulated within the housing 102 to chill the products via one or more fans. The airflow within the housing may be configured such that the air flows in a vertical direction about the dispensing ports 108 or is otherwise in a direction perpendicular to the opening of the dispensing port 108. Accordingly, the egress of chilled air from the beverage dispenser 100 may be limited. Therefore, the beverage dispenser 100 of the present disclosure provides for easy access to the chilled products contained therein similar to an open front cooler, but with an improved energy efficiency and cost similar to a glass door cooler. Any type of refrigeration unit 136 may be used herein, including a refrigeration cycle or an ice well. In some instances, the refrigeration unit 136 may be a heating device or the like.

Figure 10B:
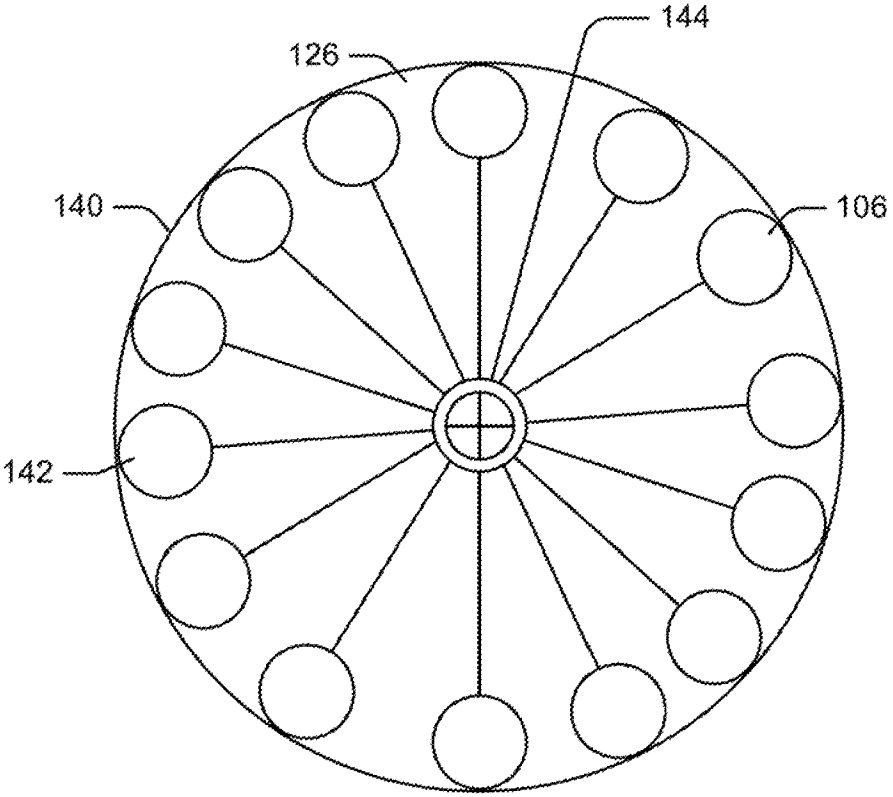
FIGS. 10A-10D schematically depict a dispensing mechanism for a beverage dispenser in accordance with one or more embodiments of the disclosure.
Figure 10A:
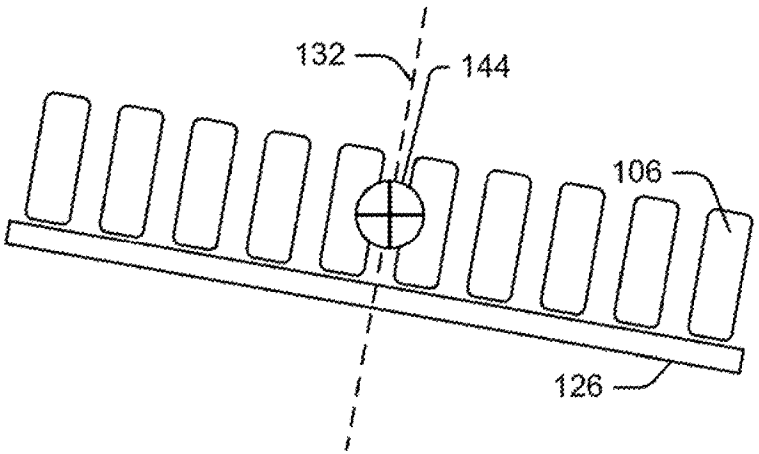

FIGS. 10A-10D schematically depict an example embodiment of the dispensing mechanism for the beverage dispenser 100. As discussed above, the tray 126 may be tilted towards the dispensing port 108 relative to the shaft 110. As depicted in FIGS. 10A and 10B, the tray 126 may be filled with a number of products 106. More or fewer products 106 may be placed on the tray 126. In this instance, each product 106 is disposed about a perimeter 140 of the tray 126. The products 106 may be located anywhere on the tray 126. In some instances, the tray 126 may include stalls 142 or the like, which may maintain the products 106 in place.

Figure 10D:
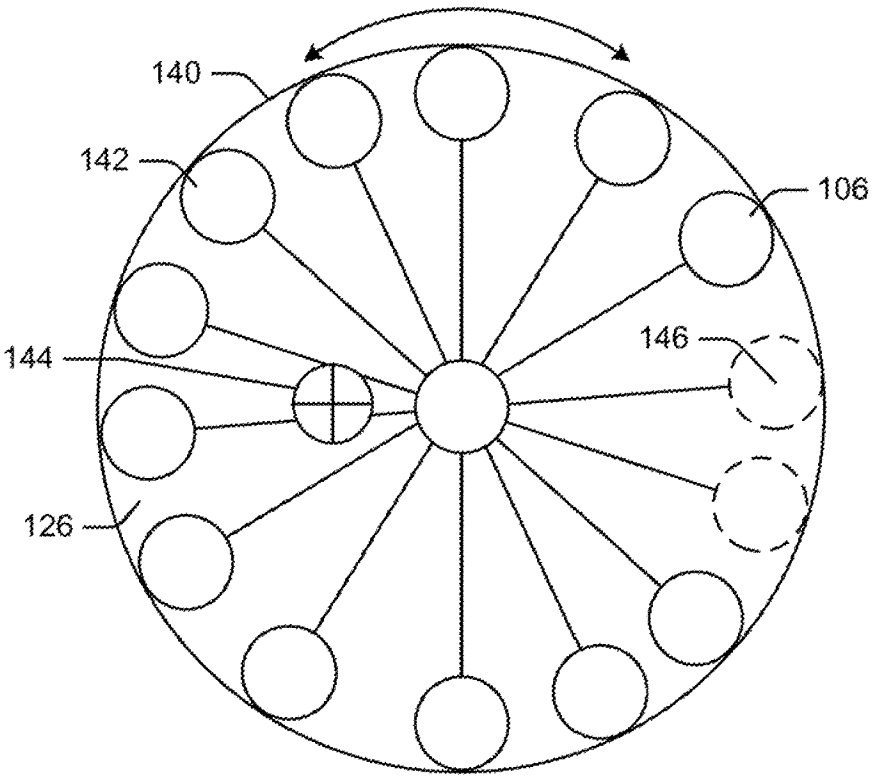
Figure 10C:
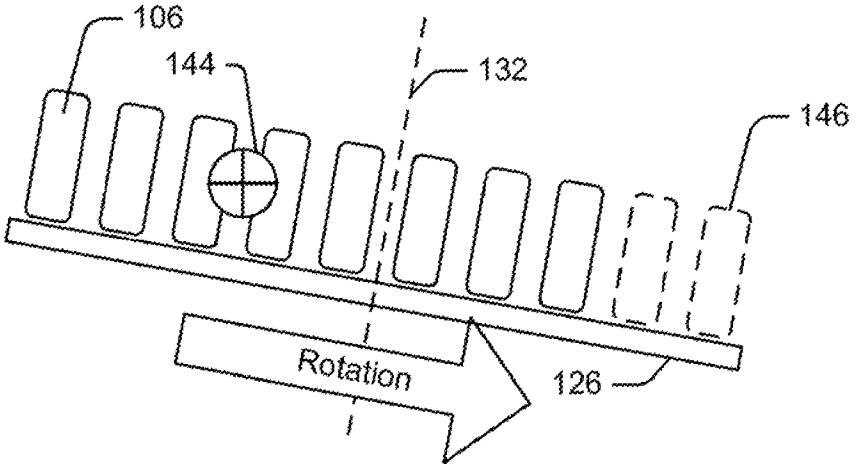

Still referring to FIGS. 10A and 10B, in some instances, the collective center of gravity 144 of the products 106 may be located about the axis of rotation 132 of the tray 126. In this manner, the tray 126 may not rotate. However, as depicted in FIGS. 10C and 10D, after one or more of the products 146 disposed on the tray 126 are dispensed or otherwise removed, the collective center of gravity 144 of the remaining product(s) 106 on the tray 126 may shift away from the axis of rotation 132 of the tray 126, causing an imbalance, and the tray 126 may rotate using gravity to bring another product 106 to the dispensing port 108. The tray 126 may automatically rotate a product 106 to the dispensing port 108 after a product 106 is dispensed without any power or drive mechanism because the tilt and rotation of the tray 126 enables self-alignment of the tray 126 with the dispensing port 108 using gravity.

In the various embodiments described herein, the beverage dispenser 100 may operate to facilitate cooling or supercooling the one or more products 106 housed therein. For example, in order to supercool a product, such as a beverage, without freezing the product, the temperature of the product may be precisely maintained within a temperature band of about 2-3 F°. Rather than relying on elaborate sensor and fan configurations to maintain tight control of product temperature, the periodic rotation of the product through different cooling zones within the housing 102 of the beverage dispenser 100 may facilitate temperature control precise enough to maintain the product at a desired temperature, such as a supercooled temperature, without freezing the product. That is, based on the rotation of the products within the housing 102, the opportunity for equalizing the temperature of products in different zones of the beverage dispenser 100 is higher than if the products were stationary. In some examples, to further facilitate supercooling of the products, one or more doors may be added to each of the dispensing ports 108 to reduce the intake of warm air.

As discussed above, the airflow within the housing 102 may be configured such that the air flows in a vertical direction about the dispensing ports 108 or is otherwise in a direction perpendicular to the opening of the dispensing port 108. In some instances, to promote supercooling of the one or more products 106, the housing 102 may further be configured such that the distribution of air establishes one or more supercooling zones where colder air or an increase flow rate of cooling air may be focused. For example, one such supercooling zone may be in an area around the one or more products 106 in or about a dispensing port 108.

In certain embodiments, different supercooling zones may be configured within the housing 102 to facilitate supercooling of different products with different supercooling temperatures. For example, as shown in FIG. 2, the product dispensing ports 108 may be offset from each other. Accordingly, a different supercooling zone may be configured about two or more of the product dispensing ports 108. In some embodiments, products that require more precise temperature control to prevent freezing or products with a lower supercooling temperature may be located closer to the bottom of the housing 102 to facilitate increase control. Moreover, one or more of the dispensing ports 108 may simply provide cooled products, while one or more other dispensing ports 108 may provide supercooled products. For example, the top most dispensing port 108 may provide cooled products while the bottom most dispensing port 108 may provide supercooled products. Other configurations may be used.

In one example, a first product may be immediately adjacent to a first dispensing port and accessible for the next dispensing of the first product from the first dispensing port. Adjacent products may be immediately adjacent to the first product on either side and behind the first product and come into contact with the first product. Adjacent products may include additional products besides the immediately adjacent and contacting products to the first product. The airflow within the housing 102 may be configured to create a first cooling zone such that the first product and the adjacent products are within a flow of air that maintains those products at a supercooling temperature. Additional products within the housing 102 may be maintained in a second cooling zone at a higher temperature than the first cooling zone. In the second cooling zone, the airflow within the housing 102 may be configured such that the products in the second cooling zone are maintained at a temperature close to a supercooling temperature for the products, such as within about 5 F° of the supercooling temperature of the products.

Additional cooling zones may be used to maintain products at a different temperature to the first and second cooling zones.

In some instances, the cooling zones may become progressively colder as a product rotates closer to the dispensing port 108. Any number of cooling zones may be used. For example, a cooling zone furthest away from the dispensing port 108 may have a higher temperature than a cooling zone nearest the dispensing port 108. In this manner, a product may be progressively cooled as it rotates towards the dispensing port 108. In such instances, for example, the product may go from a cooled state to a supercooled state once it is rotated to the dispensing port 108. Similarly, in certain embodiments, the cooling zones nearest the center of the housing 102 may have a higher temperature than the cooling zones along the perimeter of the housing 102 nearest the dispensing ports 108. The localized cooling zones may increase the efficiency of the beverage dispenser 100.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. An apparatus for dispensing one or more products, the apparatus comprising:

a housing comprising a dispensing port;

a shaft disposed within the housing; and a tray rotatably attached to the shaft, wherein the tray is tilted towards the dispensing port relative to the shaft, wherein the tray rotates the one or more products disposed thereon to the dispensing port via gravity after one of the one or more products disposed on the tray is dispensed, wherein the tray comprises a plurality of trays, wherein the dispensing port comprises a plurality of dispensing ports, wherein each tray of the plurality of trays is associated with a respective dispensing port of the plurality of dispensing ports, wherein the plurality of dispensing ports are offset from one another, wherein the plurality of trays tilt in different directions with each tray tilting into the respective dispensing port; and a refrigeration unit in thermal communication with the housing.

2. The apparatus of claim 1, further comprising an access door on the housing.

3. The apparatus of claim 1, further comprising a frame disposed within the housing.

4. The apparatus of claim 3, wherein the shaft is attached to the frame.

5. The apparatus of claim 1, further comprising a tilt bearing attached to the shaft and the tray.

6. The apparatus of claim 1, wherein the shaft is vertical.

7. The apparatus of claim 1, wherein the housing is configured to promote one or more airflows from the refrigeration unit to facilitate supercooling at least one of the one or more products.

8. An apparatus for dispensing one or more products, the apparatus comprising:

a housing comprising a plurality of dispensing ports, wherein at least two of the plurality of dispensing ports are offset from one another;

a vertical shaft disposed within the housing; and a plurality of circular trays rotatably attached to the shaft, wherein the one or more products are disposed on the plurality of circular trays, wherein each tray of the plurality of trays is associated with a respective dispensing port of the plurality of dispensing ports, wherein the plurality of circular trays are tilted towards the plurality of dispensing ports relative to the shaft directions with each circular tray tilting into the respective dispensing port, wherein at least two of the plurality of trays tilt in different directions, wherein the plurality of circular trays rotate the one or more products disposed thereon to the plurality of dispensing ports via gravity after one of the one or more products disposed on the plurality of trays are dispensed.

9. The apparatus of claim 8, further comprising a frame disposed within the housing.

10. The apparatus of claim 9, wherein the shaft is attached to the frame.

11. A method for dispensing one or more products, the method comprising:

providing a housing comprising a dispensing port;

positioning a shaft within the housing; and rotatably attaching a tray to the shaft, wherein the tray is tilted towards the dispensing port relative to the shaft, wherein the tray rotates the one or more products disposed thereon to the dispensing port via gravity after one of the one or more products disposed on the tray is dispensed, wherein the tray comprises a plurality of trays, wherein the dispensing port comprises a plurality of dispensing ports, wherein each tray of the plurality of trays is associated with a respective dispensing port of the plurality of dispensing ports, wherein the plurality of dispensing ports are offset from one another, and wherein the plurality of trays tilt in different directions directions with each tray tilting into the respective dispensing port.

12. An apparatus for dispensing one or more products, the apparatus comprising:

a housing comprising a plurality of dispensing port;

wherein the plurality of dispensing ports are offset from one another;

a shaft disposed within the housing; and a plurality of trays rotatably attached to the shaft;

wherein the plurality of trays tilt in different directions with each tray tilting into a respective dispensing port;

wherein each tray rotates the one or more products disposed thereon into the respective dispensing port via gravity after one of the one or more products disposed on each tray is dispensed; and a refrigeration unit in thermal communication with the housing.

* * * * *